US006310835B1

(12) United States Patent
Mantoan et al.

(10) Patent No.: US 6,310,835 B1
(45) Date of Patent: Oct. 30, 2001

(54) METAL CASE PART WITH KNOBS MADE IN SYNTHETIC MATERIAL

(75) Inventors: Giancarlo Mantoan, Taino; Tommaso Biraghi, Sesto Calende, both of (IT)

(73) Assignee: Lascor S.p.A., Sesto Calende (IT)

( * ) Notice: Subject to any disclaimer, the term of this patent is extended or adjusted under 35 U.S.C. 154(b) by 0 days.

(21) Appl. No.: 09/694,024

(22) Filed: Oct. 23, 2000

(30) Foreign Application Priority Data

Nov. 3, 1999 (EP) ..... 99121787

(51) Int. Cl.[7] ..... G04C 17/00; G04C 19/00; G04B 37/00; G04B 29/00

(52) U.S. Cl. ..... 368/69; 368/294; 368/295; 368/319

(58) Field of Search ..... 368/69, 185–187, 368/294–296, 319–321

(56) References Cited

U.S. PATENT DOCUMENTS 3,553,958 * 1/1971 Groltoski .
3,887,963 6/1975 Harmon et al. .
4,357,791 * 11/1982 Hope et al. .
5,469,759 11/1995 Howie, Jr. .
5,631,880 5/1997 Houlihan .

FOREIGN PATENT DOCUMENTS 571 737 1/1976 (CH) .
640893 8/1994 (EP) .

* cited by examiner

*Primary Examiner*—Vit Miska
(74) *Attorney, Agent, or Firm*—Sughrue, Mion, Zinn, Macpeak & Seas, PLLC

(57) ABSTRACT

Metal case part (9) having a wall whose outer surface (11) includes separated knobs (23*a,* 23*b,* 23*c*) formed by a synthetic material, characterized in that one face (12) opposite to the outer surface (11) of the part (9) includes a groove (15) connected to said outer surface (11) by through passages (13*a,* 13*b,* 13*c*) at locations provided for the knobs (23*a,* 23*b,* 23*c*) and in that said knobs (23*a,* 23*b,* 23*c*) originate from a filler (20) made of synthetic material projecting from the outer surface (11), while being connected to each other through said through passages (13*a,* 13*b,* 13*c*) to a strand 25, also made of synthetic material, held on the bottom of the groove (15).

9 Claims, 4 Drawing Sheets

METAL CASE PART WITH KNOBS MADE IN SYNTHETIC MATERIAL

The present invention concerns a metal case part obtained by a method allowing discontinuous zones in relief made of a synthetic material, to be obtained over all or part of its surface, i.e. an object made of two metal/synthetic materials.

Hereinafter reference will be made by way of example to a watch case, and more particularly to a new design for a rotating bezel adapted to such a watch.

In the construction of watch cases there is always a difficult choice as regards the materials which have to be used. Metal, or a precious metal such as gold, used alone gives the finished product solidity and guaranteed quality, but has the drawback of making the finished product heavy, of being ill suited to machining complex shapes and of having the "cold" appearance of metal. Synthetic materials used alone have the advantage of being able to be moulded or injected with very complex shapes and varied and attractive colours, but cause the consumer to fear that he will not find in such products the qualities which he could expect from former products made entirely of metal. Certain watch case constructions are however made with two materials, in particular to lower the product price. By way of example, Swiss Patent No. 79 203 discloses a case made of precious metal of very small thickness which includes over its entire periphery a recess reinforced by a plastic filler which is not visible. Other constructions also implementing both metal and a plastic material for technical reasons can also be cited.

In European Patent No 0 370 947 disclosing a watch with a rotating bezel, said metal bezel is provided with a toothed ring made of synthetic material snap fitted between the middle part and an annular recess of the rotating bezel to co-operate with at least one click; the ring made of synthetic material is thus not visible and the watch has a totally metallic appearance.

In Swiss Patent No. 575 616 which also concerns a watch case with a rotating bezel, an outer metal ring protects an inner ring made of plastic material intended to hold the bezel in the middle part via a snap fitting, and to allow a ring made of plastic material, able to create or carry various decorative parts, to appear on the exterior.

As is seen in the aforecited examples, the plastic material used in combination with metal always has a continuous annular shape, which is either totally visible or totally hidden.

The object of the present invention is, conversely, to provide a construction made of two materials where the angular sectors of the visible portions of the case or determined zones of said sectors, are alternately metal/synthetic material giving the product a warmer aesthetic appearance than metal and/or able to provide a technical advantage such as better gripping of the object concerned.

The invention therefore concerns a metal case part having a wall whose outer surface includes separated knobs formed by a synthetic material, characterised in that one face opposite to the outer surface of the part includes a groove connected to said outer surface by through passages at locations provided for the knobs and in that said knobs originate from a filler made of synthetic material projecting from the outer surface, while being connected to each other through said through passages to a strand, also made of synthetic material, held on the bottom of the groove.

In the case of a watch case, the "parts" to which the invention can apply are of course the middle part and the bezel, whether the latter is stationary or rotatable.

The knobs apparent on the wall may, according to the invention, have varied aesthetic appearances, as regards their shape and colouring. The shape depends on the cross-section of the through passages and the colouring on the varieties of synthetic materials used. In the simplest embodiment, a single synthetic material can be used to form, via known moulding or injection moulding methods, the strand and the knobs. It is also possible to obtain knobs of different colours by performing sequential shaping of the synthetic material, i.e. by using synthetic materials having the same basic composition or compositions able to be bind to each other, but incorporating different pigments. Likewise, it is possible to use different synthetic materials for the knobs and for the strand so that the knobs are soft to the touch and the strand has good mechanical resistance.

So that the knobs, once set in place, resist external pressure, the strand to which they are connected must be held firmly in the groove. According to a first embodiment, each knob can extend over the outer surface slightly beyond the through passage to form a tip allowing axial immobilisation. According to another embodiment, when the strand is made of a synthetic material which deforms easily, the groove can include a neck portion allowing the strand to be forced in. It is also possible for the open groove of the groove to be closed by another part of the case or by a part added to the latter such as a rigid ring. In the case of a wristwatch the "other part of the case" will be for example the upper edge of the middle part if the knobs in synthetic material are arranged in the bezel. The "added part" will be for example the casing ring if said knobs are arranged in the middle part. In the event that the groove is located in proximity to the open base of a wall, said groove may be open in the base opposite the through passages in order to communicate with the outer surface of the wall.

Other advantages and features of the invention will appear more clearly upon reading the following description of a chronograph watch with a rotating bezel, made with reference to the annexed drawings, in which.

Figure 1:
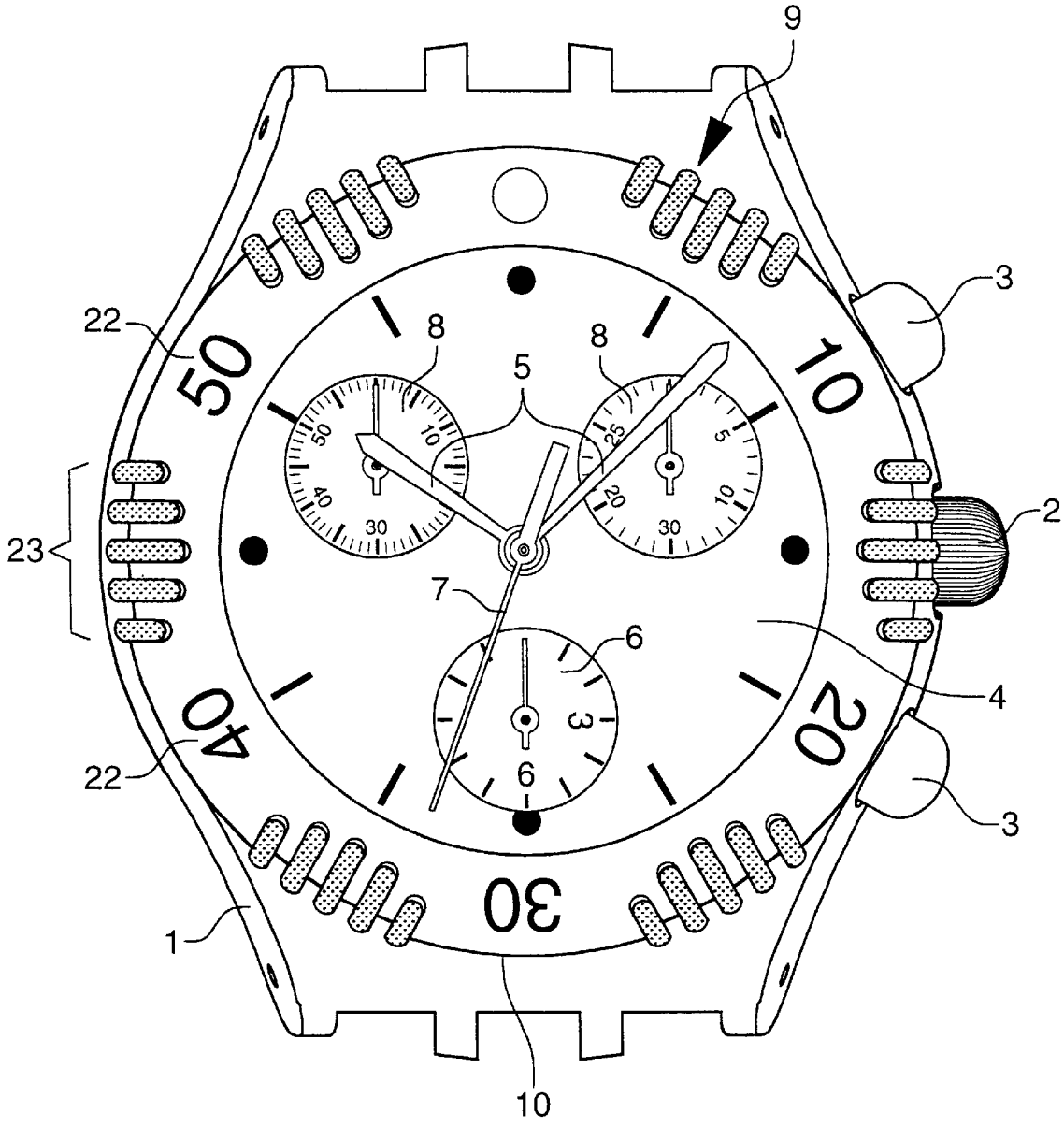
FIG. 1 is a top view of a chronograph watch with a rotating bezel, made of two materials.

The chronograph watch shown in a top view in FIG. 1 includes, in a known manner, a case inside which a chronograph movement (not shown) is placed, and whose middle part 1 includes a time-setting crown 2 and two push buttons 3 for the start/stop and zero reset functions, or for measuring an intermediate time for movements provided for this purpose. Dial 4, of circular shape, includes an analogue display, for the current time via hour/minute hands 5 and small second hand 6, and for timing via a centre second hand 7 and two counters 8. This chronograph watch also includes a rotating bezel 9, very often useful in this type of timepiece to give a time countdown, for example to give the safety indications for a diving time.

Figure 2:
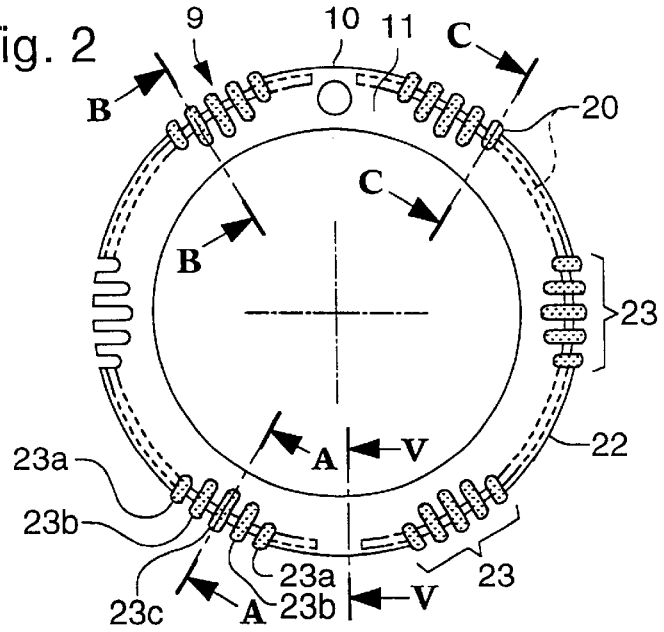
FIG. 2 is a top view of the bezel alone before it is mounted in the middle part.

This rotating bezel 9, shown separately in FIG. 2, is an illustrative example of a two-material construction according to the invention. It includes an annular profile 10 made of metal, seen from below in FIG. 3, and a filler 20 made of synthetic material shown in FIG. 4. Filler 20 forms at surface 11 of profile 10 six regularly distributed zones 23 formed of knobs 23*a,* 23*b,* 23*c,* these knobs not being shown in FIG. 2 at the 9 o'clock position for a better understanding of the shape of profile 10. Between each knob zone 23, the surface includes markings 22 for a fraction of the hour-circle of 10 minutes.

Figure 3:
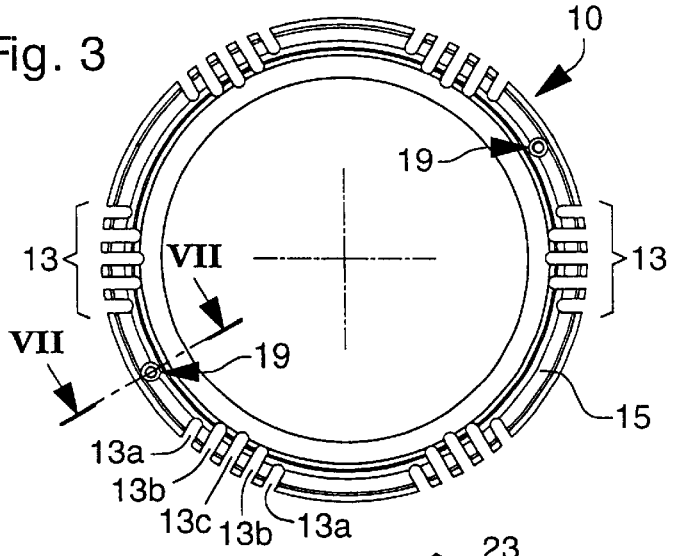
FIGS. 3 and 4 show, in a bottom view, respectively the metal part and the part made of synthetic material of the bezel.
Figure 5:
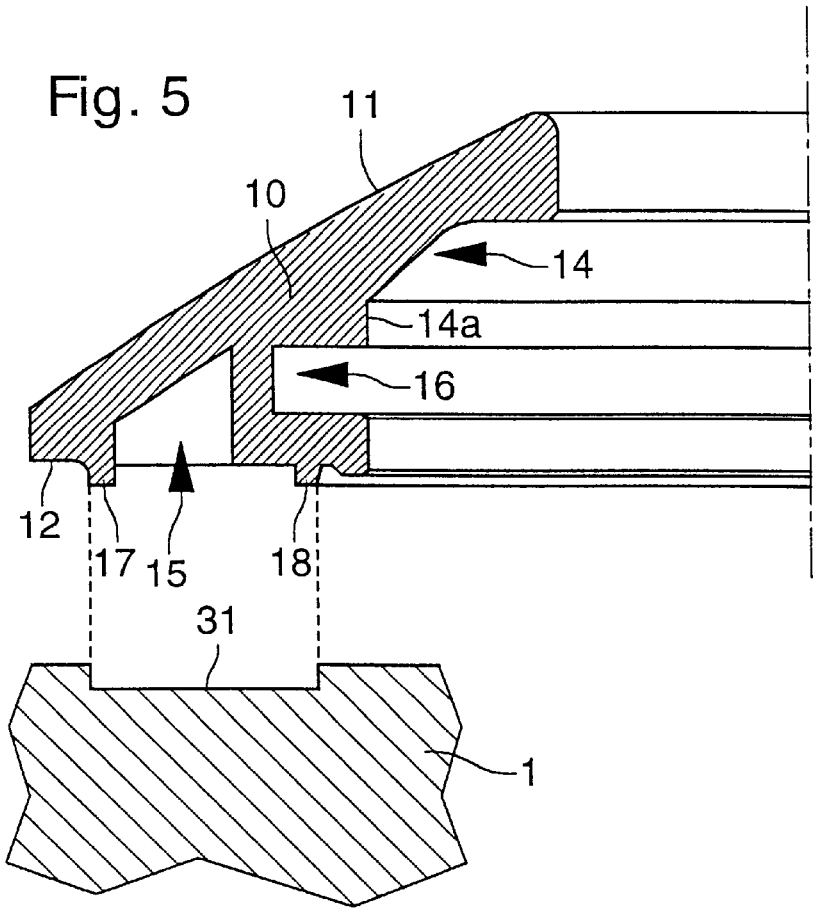
FIG. 5 is an enlarged cross-section along the line V—V of FIG. 2.
Figure 7:
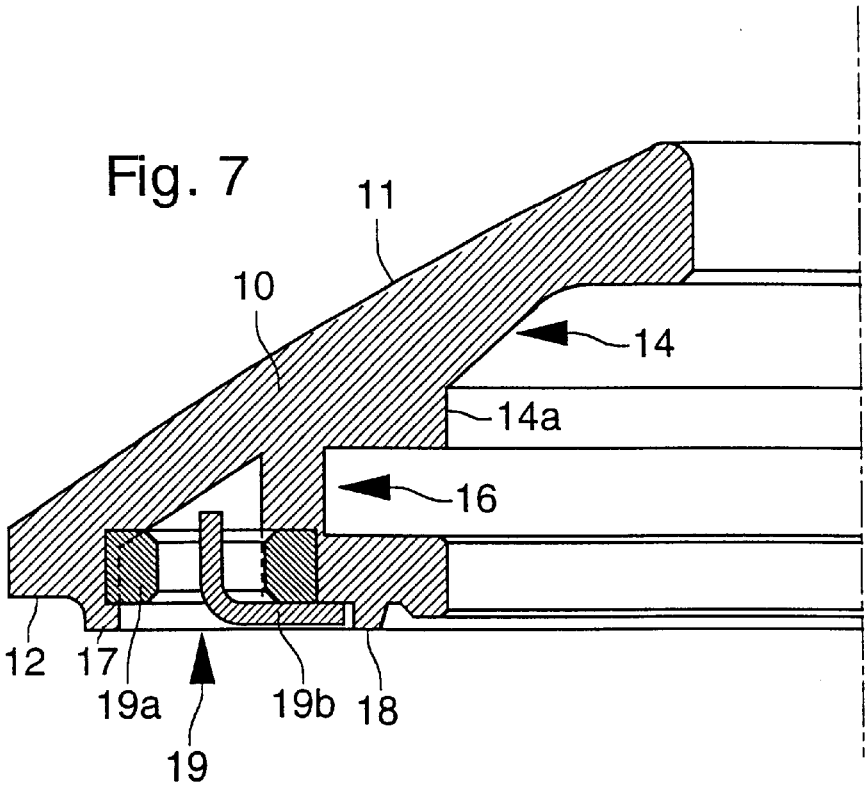
FIG. 7 is an enlarged cross-section along the line VII—VII of FIG. 3.

Referring more particularly to FIGS. 3 and 5, it can be seen that annular profile 10 includes an outer surface 11 inclined towards the exterior as far as an edge 11*a,* a base 12, and an inner wall 14 formed of a broken surface a vertical portion 14*a* of which includes a circular groove 16 intended to secure rotating bezel 9 firmly to middle part 1, by known means which are not shown. Base 12 includes over its entire periphery a groove 15 having a trapezium-shaped cross-section the sides of which are respectively parallel to outer surface 11, to base 12 and to vertical portion 14*a* of inner wall 14. Base 12 also has two small annular extensions 17, 18 the radial spacing of which is greater than the opening of groove 15 and whose outer edges are guided by the walls of an annular rotating path 31 arranged in the upper edge of middle part 1. As is seen in FIG. 3 and in the cross-section of FIG. 7, base 12 also includes two diametrically opposite zones 19 reinforced by two small metal tubes 19*a* inside which the ribs of a click spring 19*b* will be engaged.

The edge of profile 10 finally includes six regularly spaced zones 13 including notches 13*a,* 13*b,* 13*c* the bottom of which goes at least as far as groove 15. In the example shown in FIG. 3, each zone 13 includes five notches.

A central notch 13*c,* exactly positioned between two successive marks dividing the hour-circle every 10 minutes will allow, once synthetic gasket 20 is set in place, a mark every 5 minutes to be provided. Two notches 13*a* and 13*b,* of decreasing depth, are arranged on either side of this central notch 13*c*.

Annular profile 10 which has just been described is that which corresponds to the simplest machining which is most easily automated. It is clear that, notches 13*a* and 13*b* could equally have a radial orientation, like median notch 13*c,* and/or the same depth as said median notch 13*c*. Likewise, notches 13*a,* 13*b,* 13*c* could be replaced by through passages joining surface 11 and groove 15, without extending as far as edge 11*a* of profile 10.

Figure 4:
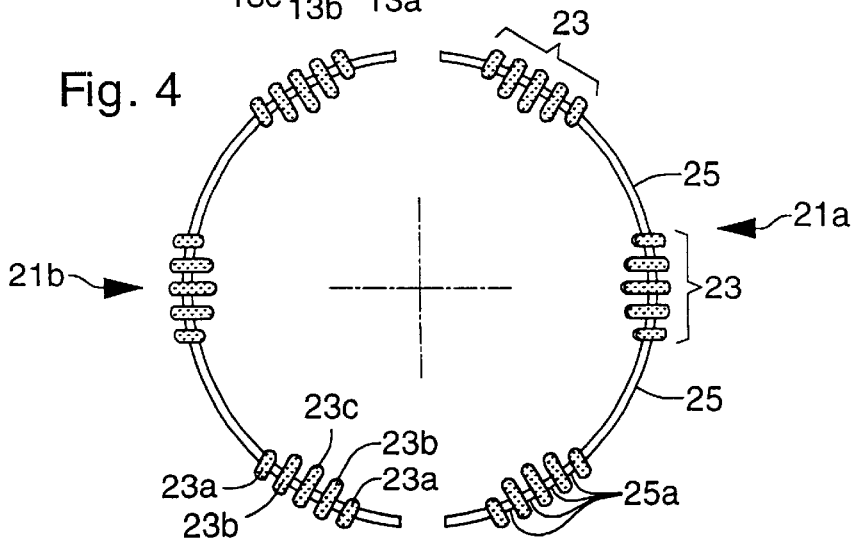

With reference now to FIG. 4, it can be seen that filler 20 made of synthetic material is in fact formed of two half sectors 21 *a,* 21*b* which are not proximate and which have a small angular shift of the order of 6° on either side of reinforced zones 19 for click spring 19*b*.

Each half sector is formed of a strand 25, of the same cross-section as groove 15 joining zones 23 of knobs 23*a,* 23*b,* 23*c* which have the same arrangement as notches 13*a,* 13*b,* 13*c*. These knob zones are distributed on strand 25 so that, after being set in place in profile 10, the six median knobs 23*c* have an angular shift of 60°.

Figure 6A:
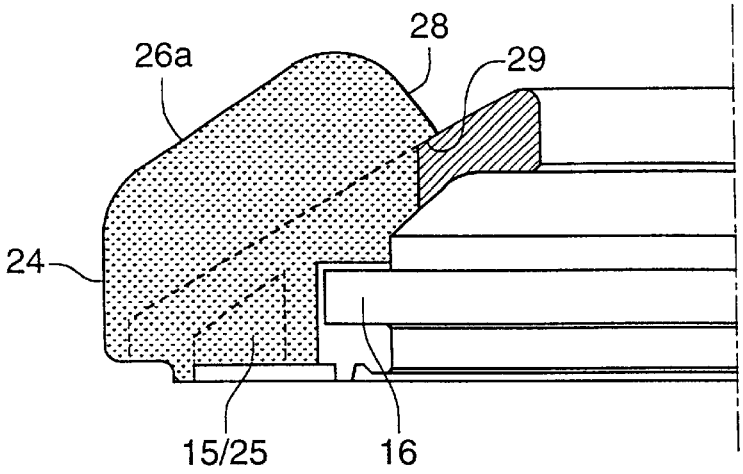
FIGS. 6A, 6B, 6C are enlarged cross-sections along the lines A—A, B—B and C—C of FIG. 2.
Figure 6B:
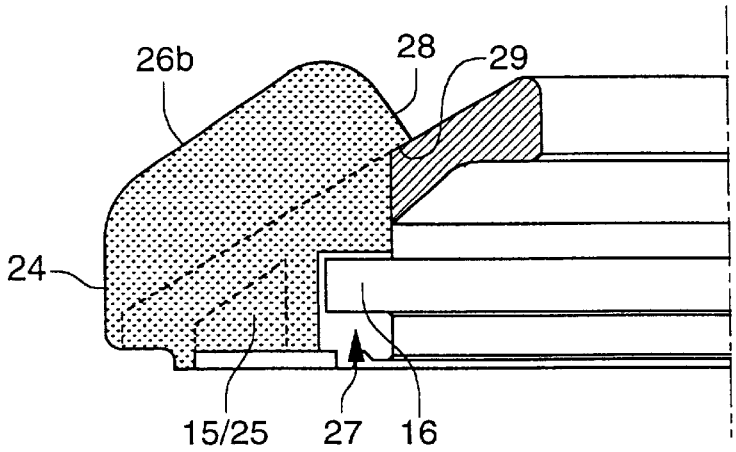
Figure 6C:
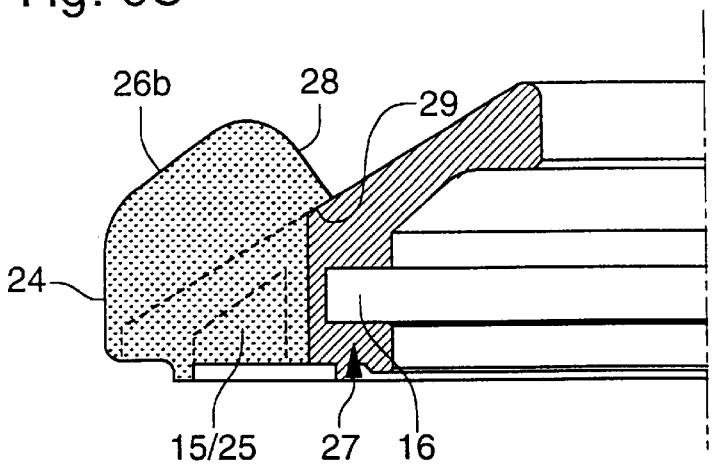

Knobs 23*a,* 23*b,* 23*c* are of course connected by small portions 25*a* of strand 25 and have different lengths adapted to the length of notches 13*a,* 13*b,* 13*c*. As is seen in the cross-section diagrams in FIGS. 6A to 6C, each knob includes a vertical portion 24, an oblique portion 26*a,* 26*b,* 26*c* which is substantially parallel to surface 11 of profile 10 and a return 28 against surface 11 extending slightly beyond a notch 13*a,* 13*b,* or 13*c* to form a tip 29, these different surfaces being connected by rounded portions. It will be noted that tip 29 allows filler 20 to be immobilised axially. According to an alternative embodiment, this axial immobilisation can be obtained by pinching strand 25 inside groove 15 the walls of which would for example be slightly inclined so that the width of groove 15 is slightly less than the width of strand 25. The different knob lengths are obtained simply be varying the length of inclined surface 26*a,* 26*b* or 26*c* of each knob. It will be noted finally, in particular in FIGS. 6B and 6C, that the base of each knob and the part thereof oriented against the bezel takes account of the technical characteristics necessary to assemble the bezel on the middle part. For this purpose, a recess 27 corresponding to groove 16 of profile 10 is provided.

Filler 20 is for example made of Pebax® by injection into a mould allowing a plurality of moulds to be obtained.

This configuration of filler 20 in two parts 21*a,* 21*b,* made necessary by the presence of two click zones 19, has the advantage of making assembly on profile 10 easier by sliding knobs 23*a,* 23*b,* 23*c* of each part 21*a,* 21*b* into notches 13*a,* 13*b,* 13*c* until portions of strand 15 click into groove 15.

As indicated at the beginning, it is possible to make filler 20 by having synthetic material which is soft to the touch for the knobs and another material having greater mechanical resistance for the strand. In such an embodiment it is then possible to make the strand in a single piece, either by keeping small tubes 19 with clicks which will then be partially driven into this second material, or by removing them and providing a serrated structure at the base of the strand.

The bezel which has just been described then has knobs made entirely of synthetic material, securely connected to each other and able to bear numerous manipulations without damage, a result which is impossible to obtain with a simple application of synthetic product on pre-shaped metal knobs. Without departing from the scope of the invention, those skilled in the art can apply the same technique to other parts of a case, or to any metal object, even if it does not correspond to the usual definition of a case.

What is claimed is:

1. A metal case part having a wall whose outer surface includes disjointed knobs formed by a synthetic material, wherein one face opposite to the outer surface of the part includes a groove connected to said outer surface by through passages at locations provided for the knobs and said knobs originate from a filler made of synthetic material projecting from the outer surface, while being connected to each other through said through passages to a strand 25, also made of synthetic material, held on the bottom of the groove.

2. A case part according to claim 1 corresponding to the bezel of a watch case with a circular dial, wherein the through passages are formed by notches, made in an edge of the bezel to join the groove through which the knobs project.

3. A case part according to claim 1, wherein the knobs are regrouped in zones regularly distributed over the surface.

4. A case part according to claim 3, wherein the knobs of each zone are symmetrical with respect to a median knob.

5. A case part according to claim 3, wherein the knobs of a same zone have different configurations.

6. A case part according to claim 1, wherein the knobs form a tip extending over the surface beyond the through passages to immobilise the filler axially.

7. A case part according to claim 2, wherein the filler is formed of two half sectors each corresponding to an arc less than 180°.

8. A case part according to claim 1, wherein the same synthetic material is used to form the totality of the filler including the strand and the knobs.

9. A case part according to claim 1, wherein all or part of the knobs are made of different synthetic materials or a same material incorporating different pigments.

* * * * *